US006261993B1

(12) United States Patent
Aono

(10) Patent No.: US 6,261,993 B1
(45) Date of Patent: Jul. 17, 2001

(54) HEAT-SENSITIVE RECORDING MATERIAL

(75) Inventor: Toshiaki Aono, Shizuoka-ken (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/419,768

(22) Filed: Oct. 18, 1999

(30) Foreign Application Priority Data

Oct. 19, 1998 (JP) ..... 10-297396

(51) Int. Cl.[7] ..... B41M 5/40
(52) U.S. Cl. ..... 503/226; 503/200
(58) Field of Search ..... 503/200, 226

(56) References Cited

FOREIGN PATENT DOCUMENTS 0 688 680 A1 12/1995 (EP) .
60-99696 6/1985 (JP) .
6-270554 9/1994 (JP) .

*Primary Examiner*—Bruce H. Hess

(74) *Attorney, Agent, or Firm*—Sughrue, Mion, Zinn, Macpeak & Seas, PLLC

(57) ABSTRACT

A heat-sensitive recording material of the present invention comprises: a support, and a heat-sensitive recording layer and a protective layer which are provided on the support, wherein the protective layer is formed by using at least a long chain alkyl ether denatured polyvinyl alcohol. Preferably, the long chain alkyl ether denatured polyvinyl alcohol is an alkyl ether denatured polyvinyl alcohol having 8 to 20 carbon atoms. More preferably, the long chain alkyl ether denatured polyvinyl alcohol is a polymer represented by the following formula (A):

14 Claims, No Drawings

HEAT-SENSITIVE RECORDING MATERIAL

BACKGROUND OF THE INVENTION

1. Field of the Invention

The present invention relates to a heat-sensitive recording material, and more particularly to a heat-sensitive recording material which comprises a support and a heat-sensitive recording layer and a protective layer which are provided on the support, and which is excellent in transparency, glossiness, and light-fastness, and which is excellent in scratch resistance because the heat-sensitive recording material has a protective layer which is excellent in friction resistance and lubricity with respect to a heat-sensitive recording head so that adhesion of the heat-sensitive recording material to the heat-sensitive recording head or the like and deposition of foreign matters thereon can be prevented.

2. Description of the Related Art

Heat-sensitive recording has been recently developing because the device used for the heat-sensitive recording is structured simply, is highly reliable, and does not need complicated maintenance. As a heat-sensitive recording material, conventionally, compounds obtained through the reaction of an electron donative colorless dye and an electron acceptive compound, and compounds obtained through the reaction of a diazonium salt compound and a coupler are widely known.

In recent years, in order to improve properties including color developing density and color developing sensitivity, fastness of a color developer and the like in heat-sensitive recording materials, extensive studies have been carried out. However, when a heat-sensitive recording material is exposed to sunlight or displayed on walls at offices or the like for a long period of time, there have been drawbacks in that background portions of the material become colored through irradiation of light, and image areas may become discolored or faded. In order to limit the discoloring or fading of image areas, various methods have been proposed. However, these methods fail to provide sufficient results.

On the other hand, in many fields such as facsimiles, printers, labels, and the like, demand for a heat-sensitive recording system is increasing. Accordingly, there is a great demand for a heat-sensitive recording material of higher performance. Image recording of the heat-sensitive recording material is carried out by a heat-sensitive recording head through imagewise heating. In order to print an image on a heat-sensitive recording material in a smooth manner without printing failures and obtain a high quality image which is excellent in glossiness, it is desired to decrease kinetic friction between the heat-sensitive recording material and the heat-sensitive recording head to a certain value or less.

Conventionally, in order to impart friction resistance and lubricity to a heat-sensitive recording material, waxes (e.g., zinc stearic acid or the like), matifying agents, pigments, and the like have been used. However, such means as described above fail to sufficiently provide improvements in friction resistance and lubricity. In addition, if the heat-sensitive recording material is a reflecting material, transparency and glossiness thereof decrease (if the heat-sensitive recording material is a transparent material, the haze degree thereof increases). Further, there have been drawbacks in that these compounds become fused to a heat-sensitive recording head, a printed surface, and the like so that failures such as deposition of foreign matters, unevenness in glossiness, and the like are caused to the heat-sensitive recording material.

SUMMARY OF THE INVENTION

It is an object of the present invention to provide a heat-sensitive recording material which is excellent in transparency, glossiness, and light-fastness and which is excellent in scratch resistance because the heat-sensitive recording material has a protective layer which is excellent in friction resistance and lubricity with respect to a heat-sensitive recording head, thus preventing adhesion of the heat-sensitive recording material to a heat-sensitive recording head or the like and deposition of foreign matters thereon.

In order to accomplish the above-described object, the present inventors carried out extensive studies, and found that addition of a long chain alkyl ether denatured polyvinyl alcohol to a protective layer provides very good results, thus achieving the present invention.

That is, the heat-sensitive recording material according to the present invention comprises a support, and a heat-sensitive recording layer and a protective layer which are provided on this support, wherein the protective layer is formed by at least a long chain alkyl ether denatured polyvinyl alcohol. Preferably, this long chain alkyl ether denatured polyvinyl alcohol is an alkyl ether denatured polyvinyl alcohol having 8 to 20 carbon atoms. More preferably, it is a polymer represented by the following formula (A).

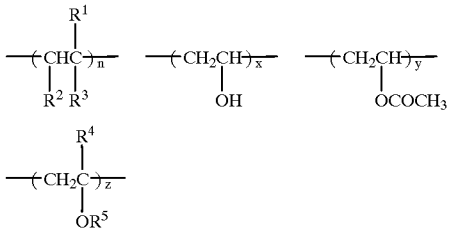

wherein $R^1$ represents a hydrogen atom, a methyl group, or $—CH_2CO_2M$; $R^2$ represents a hydrogen atom or $—CO_2M$; $R^3$ represents a hydrogen atom, $—CO_2M$, an amino group, an amide group, a substituted amide group, a hydroxy group, a glycidyl group, a sulfonic group, a polyethylene oxide group, a polypropylene oxide group, or a group including functional groups of these groups; $R^4$ represents a hydrogen atom or a methyl group; $R^5$ represents an alkyl group having 8 to 20 carbon atoms; M represents a hydrogen atom, an alkyl group, an aryl group, an aralkyl group, Na, K, or Li; and each of n, x, y, and z represents a polymerization degree.

Further, preferably, the protective layer in the heat-sensitive recording material of the present invention is formed by using at least a long chain alkyl ether denatured polyvinyl alcohol and another water-soluble binder. As the another water-soluble binder, preferably, a silicone denatured polymer or gelatin is used. Further, in the heat-sensitive recording material of the present invention, preferably, the protective layer contains inorganic ultra-fine grains. Moreover, preferably, the protective layer contains dialkyl starch as a crosslinking agent.

DETAILED DESCRIPTION OF THE PREFERRED EMBODIMENTS

A preferred embodiment of a heat-sensitive recording material according to the present invention will be explained hereinafter.

The heat-sensitive recording material of the present invention comprises a support and a heat sensitive recording layer and a protective layer which are provided on the support. The protective layer is formed by using at least a long chain alkyl ether denatured polyvinyl alcohol.

Preferably, the long chain alkyl ether denatured polyvinyl alcohol is alkyl ether denatured polyvinyl alcohol having 8 to 20 carbon atoms, and more preferably, is a polymer represented by the following formula (A):

(A)

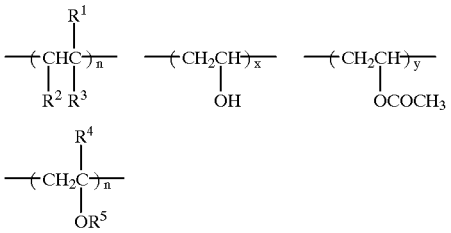

wherein $R^1$ represents a hydrogen atom, a methyl group, or —$CH_2CO_2M$, $R^2$ represents hydrogen atom or —$CO_2M$, $R^3$ represents a hydrogen atom, —$CO_2M$, an amino group, an amide group, a substituted amide group, a hydroxy group, a glycidyl group, a sulfonic group, a polyethylene oxide group, a polypropylene oxide group, or groups including these functional groups, $R^4$ represents a hydrogen atom or a methyl group. Preferably, each of $R^1$, $R^2$, and $R^4$ is a hydrogen atom, and $R^3$ is —$CO_2M$ as a combination, or each of $R^2$ and $R^4$ is a hydrogen atom, $R^1$ is —$CH_2CO_2M$, and $R^3$ is —$CO_2M$ as a combination.

M represents a hydrogen atom, an alkyl group, an aryl group, an aralkyl group, Na, K, or Li.

$R^5$ represents a long chain alkyl group, i.e., an alkyl group having 8 to 20 carbon atoms. An alkyl group may have a straight or branched chain, or it may have a substituted group such as an aryl group. Among these, from a viewpoint of lubricity, an alkyl group having 8 to 16 carbon atoms is more preferable, and a dodecyl group having 12 carbon atoms is particularly preferable.

Each of n, x, y, and z represents a polymerization degree. Preferably, n ranges from 0 to 20, and more preferably, from 0 to 10. When the value of n is large, the number of acid groups increases so that compatibility of the polymer with gelatin thereby improves. From the standpoint that characteristics of polyvinyl alcohol such as gas barrier characteristics at $T_g$ (glass transition point) can be brought out, preferably, x ranges from 60 to 99, and more preferably, x ranges from 75 to 95. Preferably, y ranges from 0 to 20. Preferably, z is large in respect of friction resistance and lubricity with respect to a heat-sensitive recording head. However, the value of z is limited in view of solubility and viscosity of an aqueous solution, and preferably, the value of z ranges from 0.5 to 10%, and more preferably, from 1 to 5% with respect to the sum of the values of n, x, y, and z.

$T_g$ (glass transition point) of these long chain alkyl ether denatured polyvinyl alcohols is 50° C. or more, and preferably, 60° C. or more. When $T_g$ is less than 50° C., scratch resistance of the protective layer deteriorates, which is not preferable.

The protective layer in the heat-sensitive recording material according to the present invention contains the long chain alkyl ether denatured polyvinyl in an amount of 50% by weight or more, and preferably, in an amount of 80% by weight or more. When the amount of long chain alkyl ether denatured polyvinyl alcohol contained in the protective layer is less than 50% by weight, the protective layer fails to sufficiently exhibit the above-described characteristics through the use of the long chain alkyl ether denatured polyvinyl alcohol.

A long chain alkyl group can be easily oriented on the surface of the protective layer of the present invention in which long chain alkyl ether denatured polyvinyl alcohol is used. Such a surface decreases kinetic friction of the protective layer with respect to the heat-sensitive recording head thus eliminating printing failures through the use of the heat-sensitive recording material of the present invention. Accordingly, it is possible for the heat-sensitive recording material to have excellent smoothness (glossiness) on a printing surface and excellent color-developing density. Further, the decrease of static friction and kinetic friction on the surface of the protective layer makes the running characteristics of a media in a printer more excellent. Moreover, a long chain alkyl ether denatured polyvinyl alcohol exhibits characteristics specific to a polyvinyl alcohol which is excellent in light-fastness and film-strength, and also improves water resistance because a hydrophobic group is oriented on the surface of the protective layer.

In the protective layer, a water-soluble binder component can be used in combination as needed other than long chain alkyl ether denatured polyvinyl alcohol. Examples of the other water-soluble binder include a silicone denatured polymer, gelatin, methyl cellulose, carboxymethylcellulose, hydroxyethylcellulose, starches, agar-agar, K-carageenan, gum arabic, casein, styrene-maleic anhydride copolymer hydrolysate, isobutylene- maleic anhydride copolymer hydrolysate, polyvinyl alcohol, denatured polyvinyl alcohol, polyacrylamide, and the like.

Among these water-soluble binders, preferably, a silicone denatured water-soluble polymer and ethylene denatured polyvinyl alcohol are used. Specific examples of the silicone denatured water-soluble polymer include those disclosed in Japanese Patent Application No. 9-7060. Among these, a silicone block denatured polyvinyl alcohol in which polyvinyl alcohol is used for a backbone polymer is particularly preferable. Ethylene denatured polyvinyl alcohol will be described later.

Examples of suitable polymers as water-soluble polymers which can be set and dried include protein such as gelatin, carageenan, polysaccharides such as agar-agar, a polyvinylalcohol compound, and the like. In the case of the polyvinylalcohol compound, it can be used as a water-soluble polymer which can be set and dried, in combination with boric acid or salt as a gelatinizer.

As the other water-soluble binder, a synthetic rubber latex, a synthetic resin emulsion, or the like can be used. Examples of monomers for forming latexes and emulsions of these polymers include acrylic acid ester, methacrylic acid ester, crotonic acid ester, vinyl ester, maleic acid diester, fumaric acid diester, itaconic acid diester, acryl amides, methacryl amides, vinyl ethers, styrenes, acrylonitrile, and the like.

Further, specific examples of acrylic acid ester which may be used for these monomers include methylacrylate, ethylacrylate, n-propylacrylate, isopropylacrylate, n-butylacrylate, isobutylacrylate, tert-butylacrylate, hexylacrylate, 2-ethylhexylacrylate, acetoxyethylacrylate, phenylacrylate, 2-methoxyacrylate, 2-ethoxyacrylate, 2-(2-methoxyethoxy) ethylacrylate, and the like.

Specific examples of methacrylic acid ester include methylmethacrylate, ethylmethacrylate, n-propylmethacrylate, n-butylmethacrylate, tert-butylmethacrylate, cyclohexylmethacrylate, 2-hydroxyethylmethacrylate, 2-etoxyethylmethacrylate, and the like.

Specific examples of crotonic acid ester include crotonic acid butyl, crotonic acid hexyl, and the like. Specific examples of vinyl ester include vinyl acetate, vinylpropionate, vinyl butylate, vinylmethoxyacetate, benzonic acid vinyl, and the like.

Specific examples of maleic acid diester include maleic acid diethyl, maleic acid dimethyl, maleic acid dibutyl, and the like. Specific examples of fumaric acid diester include fumaric acid diethyl, fumaric acid dimethyl, fumaric acid dibutyl, and the like. Special examples of itaconic acid diethyl include itaconic acid diethyl, itaconic acid dimethyl, itaconic acid dibutyl, and the like.

Specific examples of acrylamides include acrylamide, methylacrylamide, ethylacrylamide, propylacrylamide, n-butylacrylamide, tert-butylacrylamide, cyclohexylacrylamide, 2-methoxyethylacrylamide, cyclohexylacrylamide, 2-methoxyethylacrylamide, dimethylacrylamide, diethylacrylamide, phenylacrylamide, and the like.

Specific examples of methacrylamides include methacrylamide, ethylmethacrylamide, n-butylmethacrylamide, tert-butylmethacrylamide, 2-methoxymethacrylamide, dimethylmethacrylamide, diethylmethacrylamide, and the like.

Specific examples of vinyl ethers include methylvinylether, butylvinylether, hexylvinylether, methoxyethylvinylether, dimethylaminovinylether, and the like. Specific examples of styrenes include styrene, methylstyrene, dimethylstyrene, trimethylstyrene, ethylstyrene, isopropylstyrene, butylstyrene, chloromethylstyrene, methoxystyrene, butoxystyrene, acetoxystyrene, chlorostyrene, dichlorostyrene, bromostyrene, vinyl benzonic methylester, 2-methylstyrene, and the like.

A polymer formed by these monomers may be a homopolymer or a copolymer. Preferably, acrylic acid esters, methacrylic acid ester, styrenes, acrylic acids, a binary or ternary copolymer of methacrylic acid, and a copolymer of styrenes and butadiens are used.

$T_g$ (glass transition point) for forming the water-soluble binder ranges from 0° C. to 200° C., preferably from 40° C. to 150° C.

Among denatured polyvinyl alcohols, ethylene denatured polyvinyl alcohol is particularly preferable. It can by itself improve a waterproof or the like.

In order to improve water resistance and scratch resistance of the protective layer of the present invention, it is desired to use a cross-linking agent which performs a crosslinking reaction together with the long chain alkyl ether denatured polyvinyl alcohol and/or another water-soluble binder, and it is effective to use a catalyst to promote this crosslinking reaction.

It is desired that the long chain alkyl ether denatured polyvinyl alcohol and/or the water-soluble binder has at least one functional group which is chosen as a functional group from a carboxy group, an amino group, an ammonium salt group, a hydroxy group, a sulfinic acid (or its salt) group, a sulfonic acid (or its salt) group, and a glycidyl group.

Specific examples of the crosslinking agent are listed as below.

For example, crosslinking agents such as a vinyl sulfone-based compound, an aldehyde-based compound (formaldehyde, glutaraldehyde, and the like), an epoxide-based compound, an oxazine-based compound, a triazine-based compound, a high polymer hardening agent disclosed in Japanese Patent Application Laid-Open (JP-A) No. 62-234157, a methylated melamine, a blocked isocyanate, a methylol compound, a carbodiimide resin, and the like can be used.

Among these compounds, the vinyl sulfone-based compound, the aldehyde-based compound, the epoxide-based compound, the oxazine-based compound, the triazine-based compound, and the high polymer hardening agent disclosed in JP-A No. 62-234157 are particularly favorable.

As epoxy compounds, a compound having two functional groups or more can be used. Examples of these epoxy compounds include dibromophenyl glycidyl ether, dibromoneopentyl glycol diglycidyl ether, an emulsion of an epoxy crezol novolak resin, a denatured bisphenol A-type epoxy emulsion, adipic acid diglycidyl ester, o-phthalate diglycidyl ester, hydroquinone diglycidyl ether, bisphenol S glycidyl ether, telephthalate diglycidyl ether, glycidyl phthalimide, propylene polypropylene glycol diglycidyl ether, polytetramethylene glycol diglycidyl ether, arylglycidyl ether, 2-ethylhexylglycidyl ether, phenylglycidyl ether, phenol (EO) 5 glycidyl ether, p-tertiary butylphenylglycidyl ether, lauryl alcohol (EO) 15 glycidyl ether, glycidyl ether formed by an alcohol mixture having 12 to 13 carbon atoms, glycerol polyglycidyl ether, trimethylolpropanepolyglycidyl ether, resorcinol diglycidyl ether, neopentylglycoldiglycidyl ether, 1,6-hexandiolediglycidyl ether, ethylene polyethylene glycol diglycidyl ether, sorbitolpolyglycidyl ether, sorbitan polyglycidyl ether, polyglycerol polyglycidyl ether, pentaerythritol polyglycidyl ether, diglycerol polyglycidyl ether, triglycidyl-tris (2-hydroxyethyl) isocyanurate, and the like. Among these, glycidyl ethers are particularly suitable.

It is desired that an effective epoxy equivalent of the epoxy compound for the present invention ranges from 70 to 1,000 WPE. When the epoxy equivalent is more than 1,000 WPE, it becomes difficult to apply water resistance to the heat-sensitive recording material.

Blocked isocyanate refers to a compound in which a terminal isocyanate group of isocyanate is masked by a blocking agent. Examples of blocked isocyanate include: (a) a compound in which a blocking body of a hydrophobic group which is comprised of a carbamoil sulfonate group ($—NHCOSO^{3-}$) is formed at the terminal end of an isocyanate compound so that an active isocyanate group is blocked, (b) a compound in which an active isocyanate group is blocked by using isopropyliden malonate (this blocked isocyanate is obtained through the reaction between HDI isocyanulate, isopropylidenmalonate, and triethylamine), (c) a compound in which an active isocyanate group is blocked by phenols, and the like. Such blocked isocyanate as described above is mixed with ethylene denatured polyvinyl alcohol, and heated so that the quality of ethylene denatured polyvinyl alcohol improves through crosslinking, thereby achieving water resistance for the ethylene denatured polyvinyl alcohol.

Vinyl sulfonate compounds disclosed in JP-A Nos. 53-57257 and 53-41221, Japanese Patent Application Publication (JP-B) Nos. 49-13563 and 47-24259, and the like can be used.

Examples of aldehyde compounds include monoaldehyde such as formaldehyde and acetoaldehyde, and polyhydelic aldehyde such as glyoxal, glutaraldehyde, and dialdehyde starch. Examples of methylol compounds include methylolmelamine, dimethylol carbamide, and the like. An aldehyde compound is particularly suitable for a crosslinking agent. Dialdehyde starch is particularly preferable from a viewpoint of scratch resistance. Further, p-toluene sufonate is preferably used as a catalyst.

The amount of a cross-linking agent used for the above-mentioned water-soluble polymer, polymer latex, or polymer emulsion ranges from 1 to 20 parts by weight with respect to a water-soluble polymer, a polymer latex, or a polymer emulsion in an amount of 100 parts by weight. If the amount of mixture of the crosslinking agent is less than 1 part by weight, the degree of quality improvement through the reaction of crosslinking is low so that the crosslinking agent cannot provide sufficient water resistance, chemical resistance, and the like. Meanwhile, if the amount of the mixture of the crosslinking agent is more than 20 parts by weight, liquid stability deteriorates, which is not preferable.

In the present invention, sufficient friction resistance and lubricity can be ensured even if organic or inorganic pigments are not applied onto the protective layer. However, in order to further improve friction resistance and lubricity, any of common organic or inorganic pigments may be used.

Examples of the organic or inorganic pigments include calcium carbonate, aluminum hydroxide, barium sulfate, titanium oxide, talc, agalmatolite, kaolin, calcined kaolin, amorphous silica, urea-formalin resin powder, polyethylene resin powder, benzoguanamine resin powder, and the like. These compounds may be used singly or in combination of two types or more.

In an application where light-fastness is required, it is preferable to add inorganic ultra-fine grains to the heat-sensitive recording material of the present invention.

In the present invention, the term ultra-fine grains refers to grains whose mean primary particle diameter is less than or equal to 0.1 μm. A particle diameter is not specially limited if it is 0.1 μm. However, preferably, the maximum particle diameter of ultra-fine grains in a dispersion solution is 0.5 μm or less, more preferably, 0.4 μm or less, and particularly preferably, 0.35 μm or less. The frequency of (aggregated) grains whose particle diameter in the dispersion solution is 0.3 μm or more is 5% or less, and preferably, 1% or less. Particularly preferably, the frequency of (aggregated) grains whose particle diameter is 0.25 μm or more is 5% or less.

Particle diameter of the ultra-fine grains can be measured by a known method such as an N4 type sub-micron particle diameter analysis device (manufactured by Nikkaki-sha).

Examples of the inorganic ultra-fine grains include barium sulfate, zinc oxide, magnesium oxide, lead oxide, zirconium oxide, colloidal silica, or alumina. Among these compounds, barium sulfate, colloidal silica, and alumina are particularly preferable.

Examples of the inorganic ultra-fine grains which can be suitably used for the present invention and whose mean primary particle diameter is 0.1 μm or less are shown in Table 1, and are commercially available.

TABLE 1

| Fine Particle Materials | Product Name | Manufacturer |
|---|---|---|
| barium sulfate | BARIFINE BF-21 | Sakai Chemical Industry Co., Ltd. |
| barium sulfate | BARIFINE BF-20 | Sakai Chemical Industry Co., Ltd. |
| zirconium oxide | NZR-A | Nissan Chemical Industries, Ltd. |
| zinc oxide | FINEX-75 | Sakai Chemical Industry Co., Ltd. |
| titanium oxide | TTO-55 | Ishihara Sangyou Kaisha, Ltd. |
| silica | | Nippon Aerogel |

As a method in which these inorganic ultra-fine grains are mixed with a coating solution for forming the protective layer in the present invention, in order to prevent the ultra-fine grains from becoming aggregated and thereby achieve even sorption of the inorganic ultra-fine grains to surfaces of resin grains, a method in which the inorganic ultra-fine grains and an aqueous dispersed resin such as carboxymethylcellulose, gelatin, or polyvinylalcohol are mixed together as a resin solution, a method in which a colloidal dispersion is prepared by one of various mills or the like and the obtained colloidal dispersion is then mixed with the inorganic ultra-fine grains, or the like are preferably adopted from the viewpoint of effects and manufacture of the present invention. Other than the long alkyl ether denatured polyvinyl alcohol, a dispersion solution, a cross-linking agent, a catalyst, a mold releasing agent, a surfactant, a wax, and a water repellent agent may be added as necessary to the protective layer coating solution of the present invention.

The obtained protective layer coating solution is coated and dried on the heat-sensitive recording layer by a bar coater, an air knife coater, a blade coater, or a curtain coater so that the protective layer of the present invention can be provided. However, it does not matter if the protective layer is coated at the same time as the heat-sensitive recording layer or if the heat-sensitive recording layer is first coated and dried and then coated with the coating solution.

The dried coating amount of the protective layer preferably ranges from 0.1 to 3 g/m$^2$, and more preferably from 0.3 to 2.0 g/m$^2$. If the coating amount is excessive, heat sensitivity deteriorates greatly. If the coating amount is too small, the protective layer cannot exhibit the properties as a protective layer (e.g., friction resistance, lubricity, scratch resistance, or the like). After the protective layer is coated, calender processing can be applied to the resultant protective layer.

The heat-sensitive recording layer of the present invention may be a full color heat-sensitive recording layer, or a mono color heat-sensitive recording layer. However, it is preferable for the heat-sensitive recording layer to comprise at least a heat-sensitive recording layer which is provided on a support, and which comprises a diazo compound, a coupler which reacts with the diazo compound, and a binder, as main components. In the case of this heat-sensitive recording material, preferably, the protective layer is formed by using at least a chain alkyl ether denatured polyvinyl alcohol. Further, preferably, this chain alkyl ether denatured polyvinyl alcohol is formed with a water-soluble. More preferably, the heat-sensitive recording layer has a heat-recording sensitive layer formed by a diazo color-developing agent or a leuko color-developing agent, together with cyan, yellow, and magenta.

A heat-sensitive recording material in which a transparent heat-sensitive recording layer is coated on a transparent support is preferable to obtain effects of the present invention. In the case of a full color heat-sensitive recording layer, a heat-sensitive recording material is desired which comprises a light-fixation type heat-sensitive recording layer which is provided on a support, a light transmittance adjusting layer in which light transmittance having a wavelength range within which images are fixed to the light-fixation type heat-sensitive recording layer decreases after fixation of the images, and a protective layer which is provided on these layers.

Preferably, the light-fixation type heat-sensitive recording layer comprises a heat-sensitive recording layer which contains a diazonium salt compound having a maximum absorption wavelength of 360±20 nm and a coupler which reacts with the diazonium salt compound to thereby develop color, and a light-fixation type heat-sensitive recording layer which contains a diazonium salt compound having a maximum absorption wavelength of 400±20 nm and a coupler which reacts with the diazonium salt compound to thereby develop color.

Preferably, the heat-sensitive recording material comprises a heat-sensitive recording layer which is provided on the support and contains an electron donative dye and an electron acceptive compound, a light-fixation type heat-sensitive recording layer which contains a diazonium salt compound having a maximum absorption wavelength of 400±20 nm and a coupler which reacts with the diazonium salt compound to thereby develop color, a light-fixation type heat-sensitive recording layer which contains a diazonium salt compound having a maximum absorption wavelength of 360±20 nm and a coupler which reacts with the diazonium salt compound to thereby develop color, and a light transmittance adjusting layer and a protective layer, which are provided on these layers.

Also preferably, the heat-sensitive recording material comprises a light-fixation type heat-sensitive recording layer which is provided on the support and contains a diazonium salt compound having a maximum absorption wavelength of 340±20 nm or less and a coupler which reacts with the diazonium salt compound to thereby develop color, a light-fixation type heat-sensitive recording layer which contains a diazonium salt compound having a maximum absorption wavelength of 360±20 nm and a coupler which reacts with the diazonium salt compound to thereby develop color, and a light-fixation type heat-sensitive recording layer which contains a diazonium salt compound having a maximum absorption wavelength of 400±20 nm and a coupler which reacts with the diazonium salt compound to thereby develop color, and a light transmittance adjusting layer and a protective layer, which are provided on these layers.

The light transmittance adjusting layer contains therein a compound which acts as a precursor of a UV absorbent. Since the precursor does not act as a UV absorbent before the light transmittance adjusting layer is irradiated with light having the necessary wavelength range to fix an image, light transmittance through the layer is high. When images are fixed to the light-fixation type heat-sensitive recording layer, light having the necessary wavelength range to fix images thereto is sufficiently transmitted through the layer. The transmittance of visible light through this layer is high so that images can be successfully fixed to the heat-sensitive recording layer.

After the light-fixation type heat-sensitive recording layer has been irradiated with light having the necessary wavelength range to fix images thereto, the precursor of a UV absorbent acts as a UV absorbent by a reaction to light or heat. Most of the light having the necessary wavelength range to fix images to a UV region is absorbed by the UV absorbent. Accordingly, the transmittance in the UV region decreases, while the light-fastness of the heat-sensitive recording material increases. However, since the precursor of the UV absorbent cannot absorb visible light, the transmittance of visible light remains as it is.

At least one light transmittance adjusting layer can be provided in the light-fixation type heat-sensitive recording material. It is most preferable to form the light transmittance adjusting layer between the light-fixation heat-sensitive recording layer and the outermost protective layer. However, the light transmittance adjusting layer can be used as the protective layer. Properties of the light transmittance adjusting layer can be selected at will in accordance with the properties of the light-fixation type heat-sensitive recording layer.

Particularly, the present invention is effectively applicable to a heat-sensitive recording material that preferably comprises: a light-fixation type heat-sensitive recording layer which is provided on a support and contains a diazonium salt compound having a maximum absorption wavelength of 360±20 nm and a coupler which reacts with the diazonium salt compound to thereby develop color, a light-fixation heat-sensitive recording layer which contains a diazonium salt compound having a maximum absorption wavelength of 400±20 nm and a coupler which reacts with the diazonium salt compound to thereby develop color, and a light transmittance adjusting layer which is provided on these layers. In the case of the above-described heat-sensitive recording material, the transmittance of light to the light transmittance adjusting layer in a wavelength range for fixing images is preferably greater than or equal to 65% at 360 nm. After images have been fixed, the transmittance of light to the light transmittance adjusting layer is preferably less than or equal to 20% at 360 nm. In this case, "light irradiation" means that light having a wavelength of 420 nm is irradiated using a xenon lamp apparatus in an amount of 13 kJ/m$^2$. More specifically, light is irradiated by a Weather Ometer Ci65 (manufactured by Atlas Electric Co., Ltd.) in an amount of 0.9 W/m$^2$ for 4.0 hours.

The present invention is also applied to a case in which the heat-sensitive recording material comprises a light-fixation type heat-sensitive recording layer which contains a diazonium salt compound having a maximum absorption wavelength which is less than 340 nm and a coupler which reacts with the diazonium salt compound to thereby develop color, and a light-fixation type heat-sensitive recording layer which contains a diazonium salt compound having a maximum absorption wavelength which is more than 420 nm and a coupler which reacts with the diazonium salt compound to thereby develop color.

A multicolor heat-sensitive recording material is obtained by making the hue of each of the heat-sensitive recording layers different in a heat-sensitive recording layer. Namely, the hue to be developed in each multicolor heat-sensitive recording layer may be selected so as to be one of three primary colors in a subtractive color process, i.e., yellow, magenta, and cyan, thereby enabling an image to be recorded in full color. In this case, the color-developing mechanism of the heat-sensitive recording layer which is provided directly on the surface of the support (the lowest layer of the heat-sensitive recording layer) can use any of a color-developing type which comprises an electron donative dye and an electron acceptive dye, a diazo color-developing type which contains a diazonium salt and a coupler which reacts with the diazonium salt to thereby develop color, a base color-developing type which develops color by contacting a basic compound, a chelate color developing type, and a color developing type which reacts with a nucleophile, causing an elimination reaction to thereby develop color. However, a diazo color developing type is preferable. This heat-sensitive recording layer preferably comprises thereon two light-fixation type heat-sensitive recording layers which respectively contain different diazonium salt compounds having different maximum absorption wavelengths and corresponding couplers which react with the diazonium salt compounds to thereby develop color, and sequentially, a light transmittance adjusting layer and an outermost protective layer which are provided on these layers.

In the present invention, a compound which is described in JP-A No. 9-1928 can be used as the compound to be contained in the light transmittance adjusting layer.

The present invention uses conventionally known color-developing components as color-developing components used in the heat-sensitive recording layer. More preferably, the present invention uses compounds formed through the reaction of a diazonium salt compound and a coupler, or the reaction of an electron donative dye and an electron acceptive compound. Compounds used for the heat-sensitive recording layer which contains diazonium salt compounds and couplers which react with the diazonium salt compounds by heating to develop color include: diazonium salt compounds; couplers which react with the diazonium salt compounds to form dyes; and basic substances which promote the reaction of the diazonium salt compounds and couplers.

The diazonium salt compounds are those described below which are capable of controlling a maximum absorption wavelength due to the position or types of substituents of the Ar portion.

$$Ar—N_2^+.X^-$$

wherein Ar represents an aryl group, and $X^-$ represents an acid anion.

Specific examples of the diazonium salt compounds in the present invention include: acid anion salts such as 4-(N-(2-(2,4-di-tert-amylphenoxy) butyryl)piperazino) benzenediazonium, 4-dioctylaminobenzenediazonium, 4-(N-(2-ethylhexanoyl) piperazino)benzenediazonium, 4-dihexylamino-2-hexyloxybenzenediazonium, 4-N-ethyl-N-hexadecylamino-2-ethoxybenzodiazonium, 3-chloro-4-dioctylamino-2-octyloxyobenzenediazonium, 2,5-dibutoxy-4-morphorinobenzenediazonium, 2,5-octoxy-4-morphorinobenzenediazonium, 2,5-dibutoxy-4-(N-(2-ethylhexanoyl)piperazino)benzenediazonium, 2,5-diethoxy-4-(N-(2-(2,4-di-tert-aminophenoxy)butyryl)piperazino) benzenediazonium, 2,5-dibuthoxy-4-tolylthiobenzene diazonium, 3-(2-octyloxyethoxy)-4-morphorinobenzenediazonium and the like, and the below listed diazonium salt compounds D-1 to D-5. As the diazonium compounds, particularly preferable are hexafluorophosphate salts, tetrafluoroborate salts, and 1,5-naphthalenesulfonate salts.

D-1

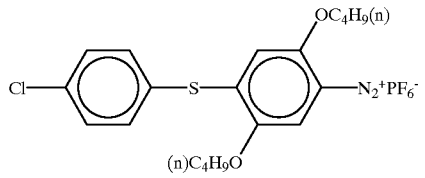

D-2

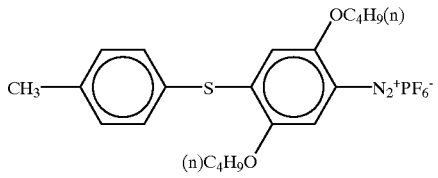

D-3

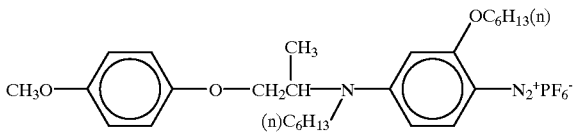

-continued

D-4

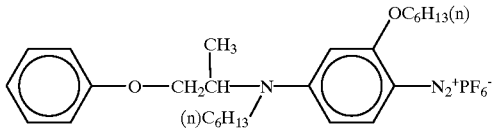

D-5

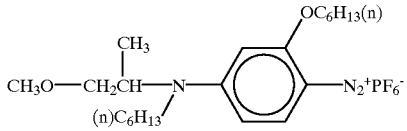

Among these diazonium salt compounds, particularly preferable compounds of the present invention which are photodecomposed by light having a wavelength of 300 to 400 nm include: 4-(N-(2-(2,4-di-tert-amylphenoxy) butyryl) piperazino) benzenediazonium, 4-dioctylaminobenzenediazonium, 4-(N-(2-ethylhexanoyl) piperazino)benzenediazonium, 4-dihexylamino-2-hexyloxybenzenediazonium, 4-N-ethyl-N-hexadecylamino-2-ethoxybenzodiazonium, 2,5-dibutoxy-4-(N-(2-ethylhexanoyl) piperazino)benzenediazonium, 2,5-diethoxy-4-(N-(2-(2,4-di-tert-amylphenoxy)butyryl) piperazino)benzenediazonium or the compounds described in the aforementioned specific examples D-3 to D-5.

The maximum absorption wavelength of these diazonium salt compounds is determined by measuring each of the compounds formed into a coating film having a thickness of 0.1 g/m$^2$ to 1.0 g/m$^2$ with a spectrophotometer (Shimazu MPS-2000).

Couplers, which are used in the present invention and react with the aforementioned diazonium salts by heating so as to develop color, include: resorcin, phloroglucin, sodium 2,3-dihydroxynaphthalene-6-sulfonate, 1-hydroxy-2-naphthoic acid morpholinopropylamide, 1,5-dihydroxynaphthalene, 2,3-dihydroxynaphthalene, 2,3-dihydroxy-6-sulfanyl-naphthalene, 2-hydroxy-3-naphthoic acid anilide, 2-hydroxy-3-naphthoic acid ethanolamide, 2-hydroxy-3-naphthoic acid octylamide, 2-hydroxy-3-naphthoic acid-N-dodecyloxypropylamide, 2-hydroxy-3-naphthoic acid tetradecylamide, acetanilide, acetoacetanilide, benzoylacetanilide, 2-chloro-5-octylacetoacetanilide, 1-phenyl-3-methyl-5-pyrazolone, 1-(2', octylphenyl)-3-methyl-5-pyrazolone, 1-(2',4',6'-trichlorophenyl)-3-benzamide-5-pyrazolone, 1-(2',4',6'-trichlorophenyl)-3-anilino-5-pyralone, 1-phenyl-3-phenylacetamide-5-pyrazolone, and the below-listed compounds C-1 to C-6. Two or more of these couplers can be mixed to obtain the desired color-developing hue.

C-1

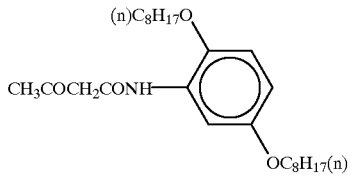

-continued

C-2

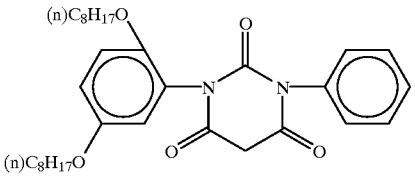

C-3

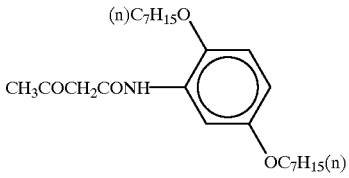

C-4

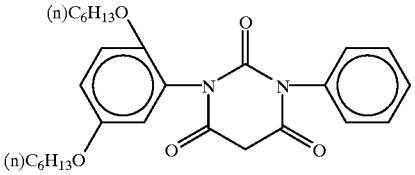

C-5

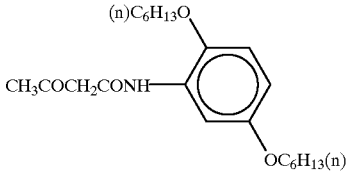

C-6

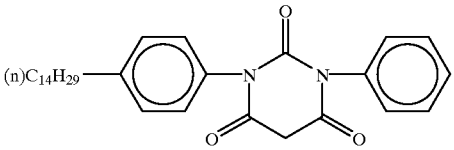

In addition to inorganic or organic basic compounds, basic substances include compounds which decompose or the like and discharge alkali substances when heated. Typical examples of these compounds include: nitrogen-containing compounds such as organic ammonium salts, organic amine, amide, urea and thiourea, and derivatives thereof, and thiazoles, pyrrols, pyrimidines, piperazines, guanizines, indoles, imidazoles, imidazolines, triazoles, morpholines, pyperidines, amidines, formazines, pyridines and the like. Specific examples of these compounds include tricyclohexylamine, tribenzylamine, octadecylbenzylamine, stearylamine, aryl urea, thiourea, methyl thiourea, aryl thiourea, ethylene thiourea, 2-benzylimidazole, 4-phenylimidazole, 2-phenyl-4-methylimidazole, 2-undecylimidazoline, 2,4,5-trifuryl-2-imidazoline, 1,2-diphenyl-4,4-dimethyl-2-imidazoline, 2-phenyl-2-imidazoline, 1,2,3-triphenylguanidine, 1,2-dicyclohexylguanidine, 1,2,3-tricyclohexylguanidine, guanidinetrichloroacetate, N,N'-dibenzylpiperadine, 4,4'-dithiomorpholine, morpholiniumtrichloroacetate, 2-aminobenzothiazole, 2-benzoylhydradinobenzothiazole, and the like. Two or more of these compounds can used in combination.

Examples of the electron donative precursors used in the present invention include: triarylmethane compounds, diphenylmethane compounds, thiazine compounds, xanthene compounds, and spiropyrane compounds. Specifically, triarylmethane compounds and xanthene compounds are useful because they can produce high color-developing densities. These compounds include 3,3-bis(p-dimethylaminophenyl)-6-dimethylaminophthalide (i.e., crystal violet lactone), 3,3-bis(p-dimethylamino)phthalide, 3-(p-dimethylaminophenyl)-3-(1,3-dimethylindole-3-yl) phthalide, 3-(p-dimethylaminophenyl)-3-(2-methylindole-3-yl)phthalide, 3-(o-methyl-p-diethylaminophenyl)-3-(2-methylindole-3-yl)phthalide, 4,4'-bis(dimethylamino) benzhydrinebenzyl ether, N-halophenylleukoauramine, N-2,4,5-trichlorophenylleukoauramine, rhodamine-B-anilinolactam, rhodamine(p-nitroanilino)lactam, rhodamine-B-(p-chloroanilino) lactam, 2-benzilamino-6-diethylaminofluoran, 2-anilino-6-diethylaminofluoran, 2-anilino-3-methyl-6-diethylaminofluoran, 2-anilino-3-methyl-6-cyclohexylmethylaminofluoran, 2-anilino-3-methyl-6-isoamylethylaminofluoran, 2-(o-chloroanilino)-6-diethylaminofluoran, 2-octylamino-6-diethylaminofluoran, 2-ethoxyethylamino-3-chloro-2-diethylaminofluoran, 2-anilino-3-chloro-6-diethylaminofluoran, benzoylleukomethylene blue, p-nitrobenzilleukomethylene blue, 3-methyl-spiro-dinaphtopyran, 3-ethyl-spiro-dinaphtopyran, 3,3'-dichloro-spiro-dinaphtopyran, 3-benzilspirodinaphtopyran, and 3-propyl-spiro-dibenzopyran.

Examples of the electron acceptive compounds include phenol derivatives, salicylic acid derivatives, and hydroxy benzoic ester. Bisphenols and hydroxy benzoic esters are particularly preferable. Examples of these compounds include 2,2-bis(p-hydroxyphenyl) propane (i.e., bisphenol A), 4,4'-(p-phenylenediisopropylidene) diphenol (i.e., bisphenol P), 2,2-bis(p-hydroxyphenyl)pentane, 2,2-bis(p-hydroxyphenyl)ethane, 2,2-bis(p-hydroxyphenyl) butane, 2,2-bis(4'-hydroxy-3',5'-dichlorophenyl)propane, 1,1-(p-hydroxyphenyl)cyclohexane, 1,1-(p-hydroxyphenyl) propane, 1,1-(p-hydroxyphenyl)pentane, 1,1-(p-hydroxyphenyl)-2-ethylhexane, 3,5-di(α-methylbenzil) salicylic acid and its polyvalent metallic salts, 3,5-di(tert-butyl)-salicylic acid and its polyvalent metallic salts, 3-α, α-dimethylbenzilsalicylic acid and its polyvalent metallic salts, butyl p-hydroxybenzoate, benzil p-hydroxybenzoate, 2-ethylhexyl p-hydroxybenzoate, and p-phenylphenol, p-cumylphenol.

As sensitizers, low melting point organic compounds which include, in an appropriate amount, aromatic groups and polar groups in a molecule are preferable. Examples of such sensitizers include benzil p-benziloxybenzoate, α-naphthylbenzil ether, β-naphthylbenzil ether, phenyl β-naphthoate, phenyl α-hydroxy-β-naphthoate, β-naphthol-(p-chlorobenzil)ether, 1,4-butanediolphenyl ether, 1,4-butanediol-p-methylphenyl ether, 1,4-butanediol-p-ethylphenylether, 1,4-butanediol-m-methylphenylether, 1-phenoxy-2-(p-tolyloxy)ethane, 1-phenoxy-2-(p-ethylphenoxy)ethane, 1-phenoxy-2-(p-chlorophenoxy) ethane, and p-benzilbiphenyl.

In the present invention, the methods of using the above-described diazonium salt compounds, the couplers which react with the diazonium salt compounds so as to develop color, the basic substances, the electron donative colorless dyes, the electron acceptive compounds, and the sensitizers are not particularly limited. Namely, there are employed methods in which these substances are (1) solidly dispersed, (2) emulsified and dispersed, (3) polymer dispersed, (4) latex dispersed, (5) encapsulated in a microcapsule, and the like. However, among these methods, particularly from a storage point of view, a method in which the substances are encapsulated in microcapsules is preferable. In the color-developing system using the reaction of the diazonium salt compound and the couplers, diazonium salt compounds encapsulated in microcapsules are preferable. In the color-developing system using the reaction of the electron donative colorless dyes and the electron acceptive compounds, the electron donative colorless dyes encapsulated in microcapsules are preferable.

As a method of producing microcapsules, a conventionally known method can be used. Namely, color-developing agents, additives, and a precursor for a microcapsule wall are dissolved in organic solvent that is difficult to dissolve in water, or insoluble in water. The resultant solution is added to a water-soluble high polymer aqueous solution, emulsified by means of a homogenizer or the like, and the temperature thereof is raised. The high polymer substance for the microcapsule walls can be prepared by forming wall films at the interface of the oil droplets and water by heating.

Examples of the aforementioned organic solvents include low boiling point co-solvents such as acetic ester, methylenechloride, and cyclohexanone and/or phosphate ester, phthalate ester, acrylate ester, methacrylate ester, other carboxylilc acid ester, fatty acid amide, alkylated biphenyl, alkylated terphenyl, alkylated naphthalene, diarylethane, chlorinated paraffin, alcohols, phenols, ethers, monolefines, epoxys, and the like. Specific examples of such compounds include high boiling point oils such as tricresyl phosphate, trioctyl phosphate, octyldiphenyl phosphate, tricyclohexyl phosphate, dibutyl phthalate, dioctyl phthalate, dilauryl phthalate, dicyclohexyl phthalate, olefinic acid butyl, diethyleneglycolebenzoate, dioctyl sebacate, dibutyl sebacate, dioctyl adipate, trioctyl trimellitate, acetyltriethyl citrate, octyl maleate, dibutyl maleate, isoamylbiphenyl, chlorinated paraffin, diisopropylnaphthalene, 1,1'-ditolyethane, 2,4-ditertiaryamylphenol, N,N'-dibutyl-2-buthoxy-5-tertiaryoctylaniline, 2-ethylhexyl hydroxybenzonate, and polyethyleneglycole. However, among these compounds, it is particularly preferable to use alcohols, phosphoric esters, carboxylic acid esters, alkylated biphenyl, alkylated terphenyl, alkylated naphthalene, and diarylethane. Further, carbonization inhibitors such as hindered phenol and hindered amine can be added to the aforementioned high boiling point oils. Moreover, it is particularly preferable to use oils having unsaturated fatty acid such as α-methylstyrenedimer. As the α-methylstyrenedimer, for example, MSD100 (manufactured by Mitsui Toatsu Co., Ltd.) can be used.

As a water-soluble high polymer, a water-soluble high polymer such as polyvinyl alcohol is used. However, an emulsion or latex having a hydrophobic high polymer can be used together with this compound. Examples of such water-soluble high polymers include polyvinyl alcohol, silanol denatured polyvinyl alcohol, carboxy denatured polyvinyl alcohol, amino denatured polyvinyl alcohol, itaconic acid denatured polyvinyl alcohol, styrene-maleic anhydride copolymer, butadiene-maleic anhydride copolymer, ethylene-maleic anhydride copolymer, isobutylene-maleic anhydride copolymer, polyacrylamide, polystyrenesulfonic acid, polyvinylpyrolidone, ethylene-acrylic acid copolymer, and gelatin. Among these, carboxy denatured polyvinyl alcohol, and acylated gelatin (e.g., gelatin phthalate) are particularly preferable. Examples of hydrophobic high polymer emulsions or latexes include styrene-butadiene copolymer, carboxy denatured styrene-butadiene copolymer, and acrylonitrile-butadiene copolymer. In this case, conventionally known surfactants can be added as needed.

Specific examples of high polymer compounds for forming microcapsule wall films include polyurethane resin, polyurea resin, polyamide resin, polyester resin, polycarbonate resin, aminoaldehyde resin, melamine resin, polystyrene resin, styrene-acrylate copolymer resin, styrene-methacrylate copolymer resin, gelatin, and polyvinyl alcohol. Among these, as a wall agent, particularly preferable is a microcapsule having a wall film which consists of polyurethane or polyurea resin.

A precursor for a microcapsule wall which consists of polyurethane or polyurea resin such as polyvalent isocyanate or the like is mixed into core substances to be encapsulated, and is emulsified in a water-soluble high polymer aqueous solution such as polyvinyl alcohol or the like. A microcapsule having a wall film can be prepared through the reaction for forming a high polymer at the interface of the oil droplets and water under heating.

A portion of specific examples of polyvalent isocyanate compounds are given below. For example, diisocyanates such as m-phenylenediisocyanate, p-phenylenediisocyanate, 2,6-trilenediisocyanate, 2,4-trilenediisocyanate, naphthalene-1,4-diisocyanate, diphenylmethane-4,4'-diisocyanate, 3,3'-diphenylmethane-4,4'-diisocyanate, xylene-1,4-diisocyanate, 4,4'-diphenylpropanediisocyanate, trimethylenediisocyanate, hexamethylenediisocyanate, propylene-1,2-diisocyanate, butylene-1,2-diisocyanate, cyclohexylene-1,2-diisocyanate, and cyclohexylene-1,4-diisocyanate; triisocyanates such as 4,4',4"-triphenylmethanetriisocyanate and toluene-2,4,6-triisocyanate; tetraisocyanates such as 4,4'-dimethyldiphenylmethane-2,2'and 5,5'-tetraisocyanate; and isocyanate prepolymers such as an adduct of hexamethylenediisocyanate and trimethylolpropane, an adduct of 2,4-tolylenediisocyanate and trimethylolpropane, an adduct of xylylenediisociatante and trimethylolpropane; and an adduct of tolylenediisocyanate and hexantriol. Two or more of the aforementioned compounds can be mixed as needed. Among these, particularly preferable is a compound having three or more of isocyanate groups in a molecule.

In the method of preparing microcapsules, as an organic solvent for dissolving color-developing agents, additives, and a precursor for a microcapsule wall, the above-listed oils used in the emulsion dispersion can be used. Further, the same applies for the water-soluble high polymers.

Preferably, a particle diameter of each of the microcapsules ranges from 0.1 to 1.0 μm, and more preferably, from 0.2 to 0.7 μm.

In the present invention, a multicolor heat-sensitive recording material may be obtained by laminating the above-described heat-sensitive recording layers and having the hue of each heat-sensitive recording layer be different from each other. The layer structure is not particularly limited. However, a multicolor heat-sensitive recording material comprising two heat-sensitive recording layers which respectively contain different diazonium salt compounds having different absorption wavelengths and corresponding couplers which react with the diazonium salt compounds through the application of heat to thereby develop different hues and a heat-sensitive recording layer which contains an electron donative colorless dye and an electron acceptive compound is preferable. Further, a multicolor heat-sensitive recording material preferably comprises three heat-sensitive recording layers which respectively contain different diazonium salt compounds having different absorption wavelengths and corresponding couplers which react with the diazonium salt compounds through application of heat to thereby develop different hues is also preferable. The latter is particularly preferable.

Namely, the multicolor heat-sensitive recording layer preferably comprises a first heat-sensitive recording layer which is provided on a support and contains an electron donative colorless dye and an electron acceptive compound or a diazonium salt compound having a maximum absorption wavelength of 340 nm or less and a coupler which reacts with the diazonium salt compound through the application of heat to thereby develop color, a second heat-sensitive recording layer which contains a diazonium salt compound having a maximum absorption wavelength of 360±20 nm and a coupler which reacts with the diazonium salt compound through the application of heat to thereby develop color, and a third heat-sensitive recording layer which contains a diazonium salt compound having a maximum absorption wavelength of 400±20 nm and a coupler which reacts with the diazonium salt compound through the application of heat to thereby develop color. In this example, the hue to be developed in each heat-sensitive recording layer may be selected so as to be one of the three primary colors in a subtractive color process, i.e., yellow, magenta, cyan, thereby allowing a full-color image to be recorded. An image is recorded on this multicolor heat-sensitive recording material in the following manner. First, the third heat-sensitive recording layer is heated so that the diazonium salt compound and the coupler contained therein develop color. Next, the unreacted diazonium salt compound contained in the third heat-sensitive recording layer is decomposed by irradiation with light having a wavelength of 400±20 nm. Subsequently, the second heat-sensitive recording layer is sufficiently heated so that the diazonium salt compound and the coupler contained therein develop color. At this time, the third heat-sensitive recording layer is also intensely heated but does not develop color any more since the diazonium salt compound contained in the third heat-sensitive recording layer has already decomposed and thus has lost its color-developing capability. Further, the multicolor heat-sensitive recording layer is irradiated with light having a wavelength of 360±20 nm so as to decompose the diazonium salt compound contained in the second heat-sensitive recording layer. Lastly, the first heat-sensitive recording layer is sufficiently heated, thereby causing the first heat-sensitive recording layer to develop color. At this time, the third and second heat-sensitive recording layers are also intensively heated but do not develop color any more since the diazonium salt compounds contained in the third and second heat-sensitive recording layers are already decomposed and thus have lost their color-developing capability.

In order to improve further the light-fastness of the heat-sensitive recording material of the present invention, the below-described known antioxidants can be used. Such antioxidants are disclosed, for example, in European Patent Laid-Open Nos. 310551, 310552, 459416, 223739, 309402, and 309401, German Patent Laid-Open No. 3435443, U.S. Pat. Nos. 4814262 and 4980275, JP-A Nos. 3-121449, 2-262654, 2-71262, 63-163351, 54-48535, 5-61166, 5-119449, 63-113536, and 62-262047.

Specific examples of such antioxidants include:

Q-1

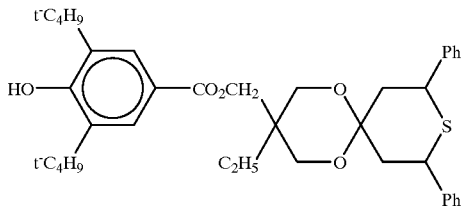

-continued

Q-2

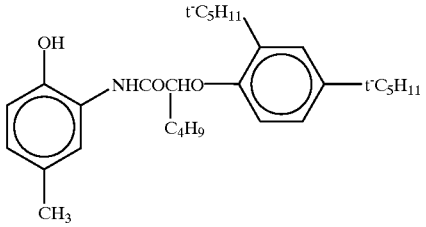

Q-3

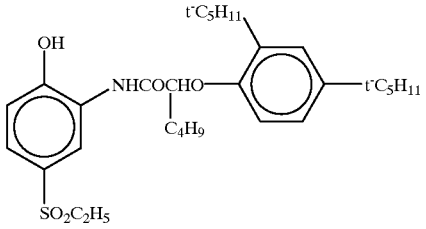

Q-4

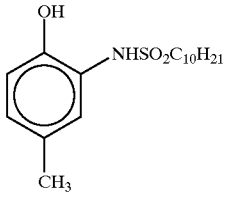

Q-5

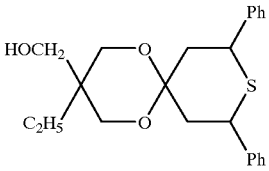

Q-6

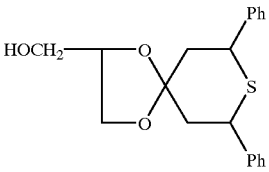

Q-7

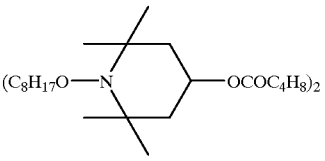

AND

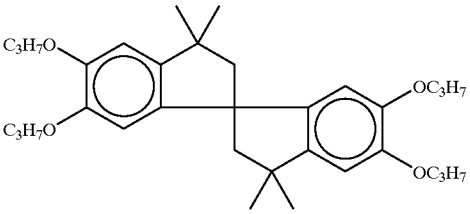

Q-8

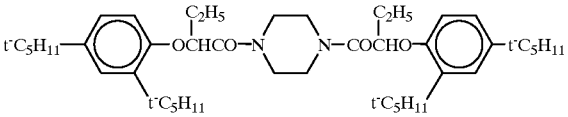

-continued
Q-9
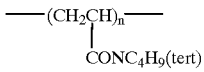
Q-10
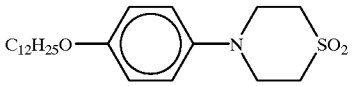
Q-11
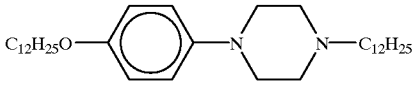
Q-12
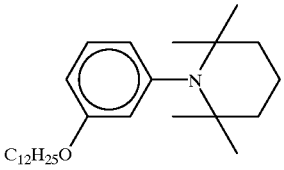
Q-13
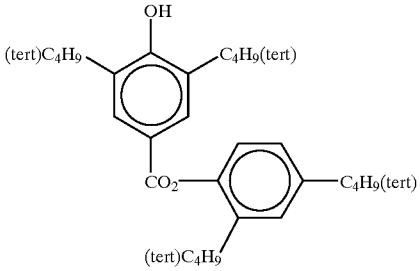
Q-14
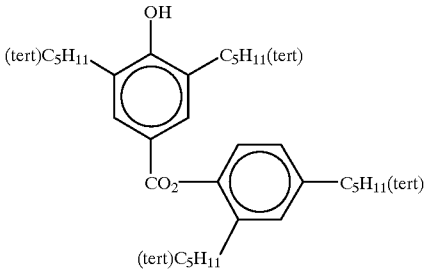
Q-15
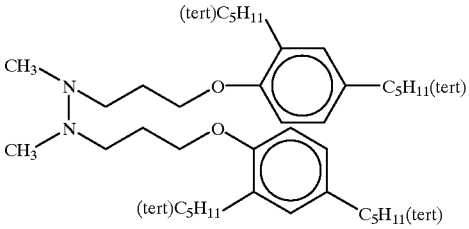
Q-16
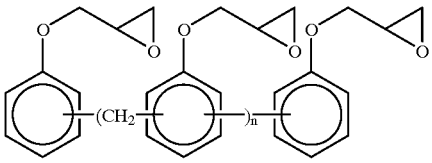
-continued
Q-17
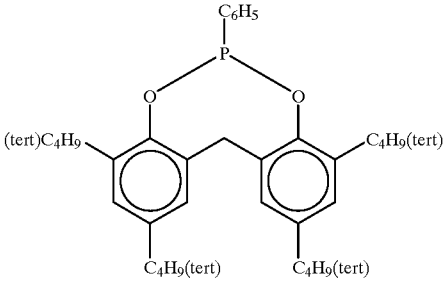
Q-18
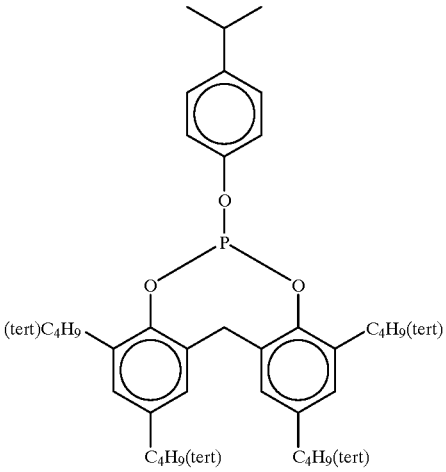
Q-19
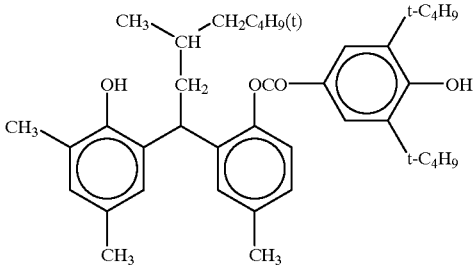
Q-20
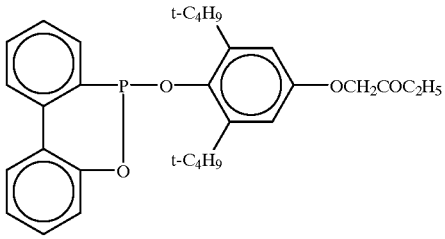
Q-21
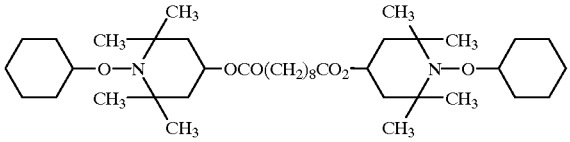

-continued

Q-22

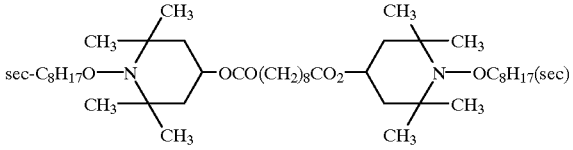

Q-23

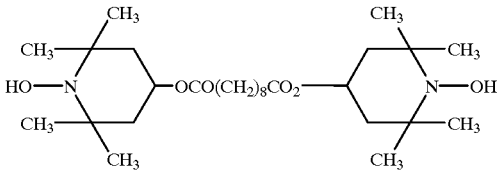

Q-24

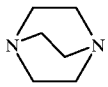

Q-25

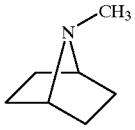

Q-26

$(C_{14}H_{27}OCOCH_2CH_2)_2S$

Q-27

$(C_{18}H_{37}OCOCH_2CH_2)_2S$

Q-28

$(C_{12}H_{25}SCH_2CH_2CO_2CH_2)_4C$

In the present invention, at least one of the light transmittance adjusting layer and the protective layer, preferably the protective layer, contains a compound in which a random copolymer having a vinyl ester unit expressed by the following equation has been saponified (which is also referred to as ethylene denatured polyvinyl alcohol).

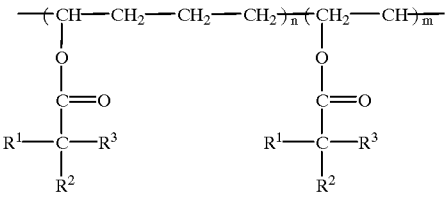

(wherein each of $R^1$, $R^2$, and $R^3$ represents a hydrogen atom or a hydrocarbon group, $R^2$ and $R^3$ may be bound with each other so as to form an annular hydrocarbon group. $R^1$, $R^2$, and $R^3$ are bound with one another so as to form an annular hydrocarbon group.)

Among these ethylene denatured polyvinyl alcohols, it is preferable to use ethylene denatured polyvinyl alcohol which is a random copolymer in which the ratio of a vinyl alcohol monomer compound in a polyvinyl alcohol to an ethylene monomer is 80:20 to 99:1. In the case of using ethylene denatured polyvinyl alcohol, in order to provide water-solubility and sufficient water resistance, preferably, the coefficient of ethylene denaturation ranges from 20 mol % (i.e., the ratio of a vinyl alcohol monomer compound to an ethylene monomer is 80:20) to 1 mol % (the ratio of a vinyl alcohol monomer compound to an ethylene monomer is 99:1). More preferably, the coefficient of ethylene denaturation ranges from 5 mol % to 10 mol %. In the case of using ethylene non-denatured polyvinyl alcohol, the ethylene non-denatured polyvinyl alcohol cannot provide sufficient water resistance and chemical resistance. When the coefficient of ethylene denaturation exceeds 20 mol %, solubility in water decreases, which is not preferable.

Preferably, the degree of saponification of the ethylene denatured polyvinyl alcohol is more than or equal to 80 mol %. In the case in which the degree of saponification of the ethylene denatured polyvinyl alcohol is less than 80 mol %, solubility of the ethylene denatured polyvinyl alcohol is insufficient so that it becomes difficult to adjust a predetermined coating solution.

These ethylene denatured polyvinyl alcohols may be further denatured by other functional groups within a range so as not to hurt performance and coating solution stability. Examples of the ethylene denatured polyvinyl alcohols include a carboxyl group, a terminal alkyl group, an amino group, a sulfonic group, a terminal thiol group, a silanol group, an amide group, and the like. In order to impart solubility to the ethylene denatured polyvinyl alcohol, it is preferable to use a sulfonic group denatured with a carboxyl group or an amino group, or the like.

It is also effective to use various additives which are already known as heat-sensitive recording materials and a pressure-sensitive recording material for the heat-sensitive recording layer of the present invention. These antioxidants are partially disclosed in JP-A Nos. 60-125470, 60-125471, 60-125472, 60-287485, 60-287486, 60-287487, 62-146680, 60-287488, 62-282885, 63-89877, 63-88380, 63-088381, 01-239282, 04-291685, 04-291684, 05-188687, 05-188686, 05-110490, 05-1108437, 05-170361, 63-203372, 63-224989, 63-267594, 63-182484, 60-107384, 60-107383, 61-160287, 61-185483, 61-211079, 63-251282, 63-051174, 48-043294, and 48-033212.

Specific examples of these include 6-ethoxy-1-phenyl-2,2,4-trimethyl-1,2-dihydroquinoline, 6-ethoxy-1-octyl-2,2,4-trimethyl-1,2-dihydroquinoline, 6-ethoxy-1-phenyl-2,2,4-trimethyl-1,2,3,4-tetrahydroquinoline, 6-ethoxy-1-octyl-2,2,4-trimethyl-1,2,3,4-tetrahydroquinoline, nickel cyclohexanate, 2,2-bis-4-hydroxyphenylpropane, 1,1-bis-4-hydroxyphenyl-2-ethylhexane, 2-methyl-4-methoxydiphenylamine, 1-methyl-2-phenylindole or the below listed compounds.

Q-29

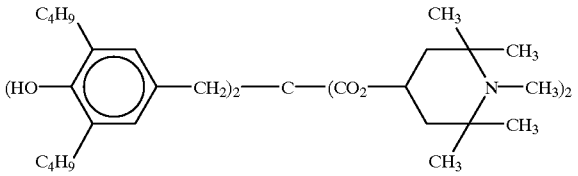

Q-30

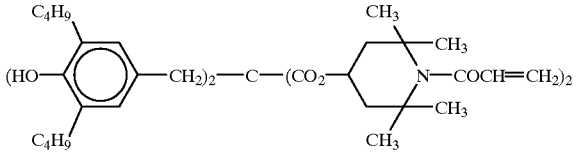

-continued
Q-31
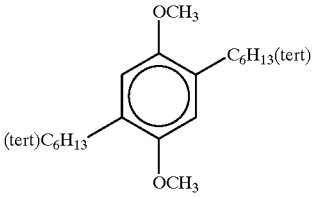
Q-32
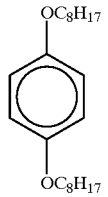
Q-33
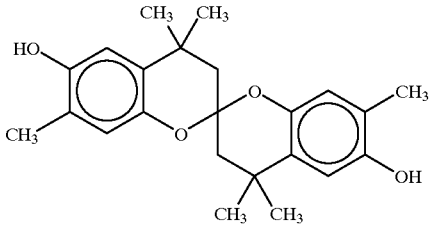
Q-34
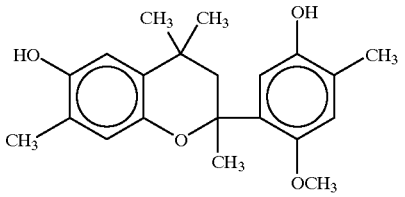
Q-35
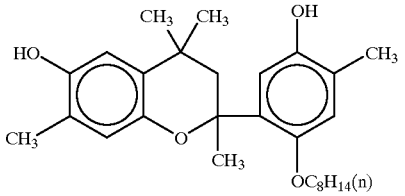
Q-36
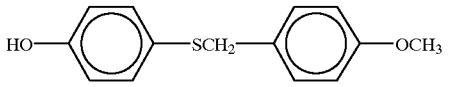
Q-37
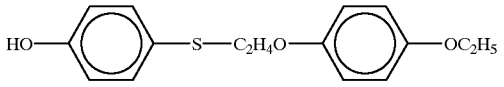
Q-38
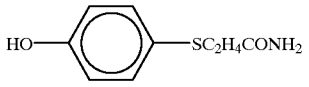
Q-39
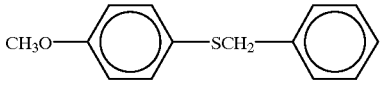
-continued
Q-40
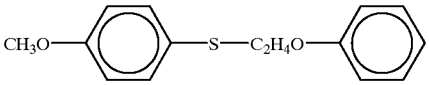
Q-41
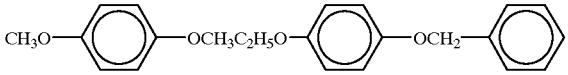
Q-42
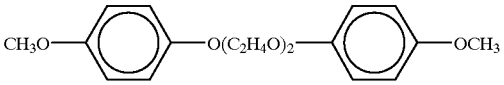
Q-43
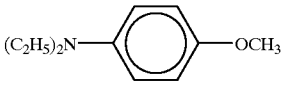
Q-44
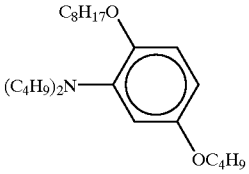
Q-45
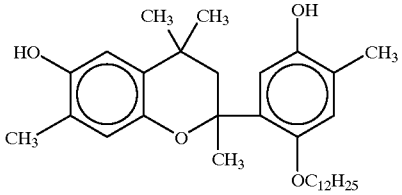
AND
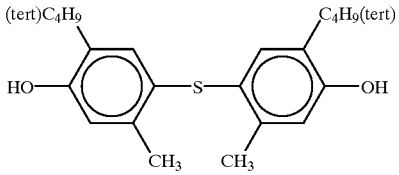
ARE USED IN COMBINATION
Q-46
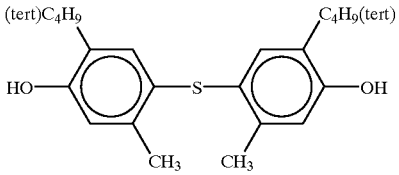
AND HYDROQUINONEETHER
ARE USED IN COMBINATION
Q-47
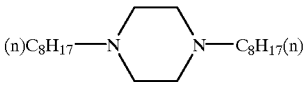
Q-48
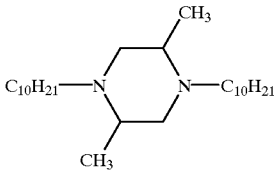

-continued

Q-49

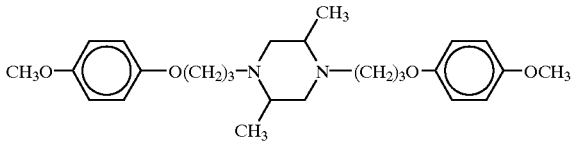

Q-50

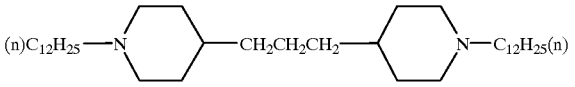

Q-51

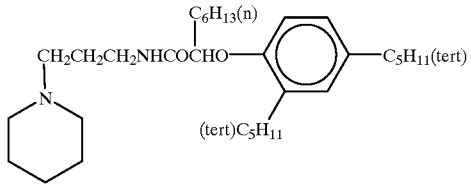

Q-52

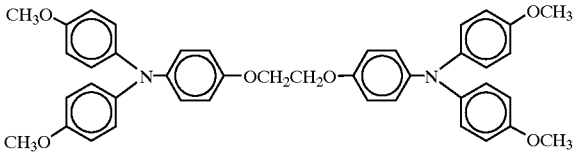

Q-53

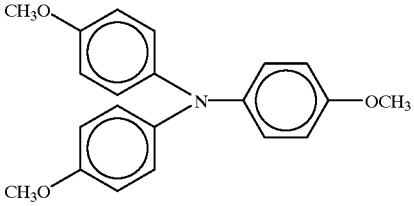

Q-54

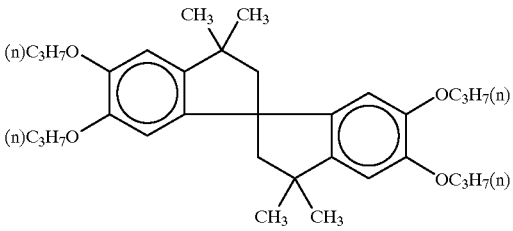

Q-55

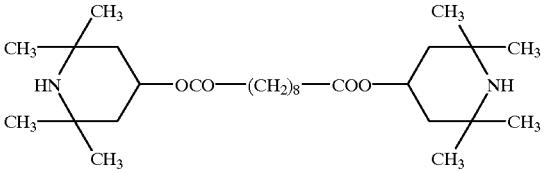

Q-56

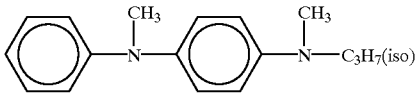

-continued

Q-57

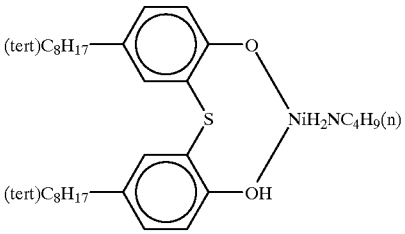

Q-58

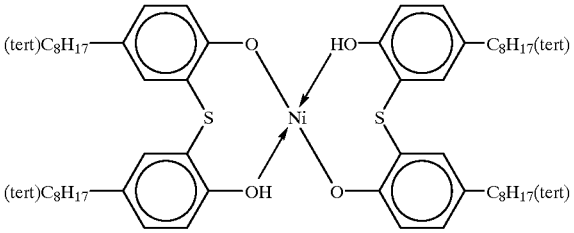

These antioxidants can be added to a heat-sensitive recording layer or an intermediate layer, a light transmittance adjusting layer, and a protective layer. When these antioxidants are used in combination, examples of these antioxidants used in combination include Examples (Q-7), (Q-45), (Q-46) or the compound (Q-10) and the compound (Q-13).

As the support used in the present invention, plastic film, paper, plastic resin-laminated paper, synthetic paper, or the like can be used.

In the present invention, if heat-sensitive recording layers having different hues are laminated, it is possible to provide an intermediate layer between the heat-sensitive recording layers in order to prevent color mixing or the like. If paper such as laminating paper having a high transmittance of $O_2$ is used as a support, it is possible to use an undercoat layer as a Low oxygen peameability layer in order to improve light-fastness. A water-soluble high polymer compound is used for an intermediate layer or an undercoat layer. Examples of these compounds include polyvinylalcohol, denatured polyvinylalcohol, methylcellulose, polystyrene-sulfonic acid sodium, styrene-maleic acid copolymer, and gelatin.

In order to prevent color mixing and to improve light-fastness in a particularly thin intermediate layer or undercoat layer, it is effective to contain therein a swelling inorganic layer compound which is disclosed in Japanese Patent Application Laid Open No. 7-113825.

In the aforementioned examples, particularly a description of the full color heat-sensitive recording material has been given. Due to the necessity of color discrimination through the application of heat for the full color heat-sensitive recording material, the images must be printed at a high temperature; thus, it is particularly preferable to provide the protective layer of the present invention for the full color heat-sensitive recording material. However, the heat-sensitive recording material of the present invention may use a heat-sensitive recording material having a mono color heat-sensitive recording layer.

The mono color heat-sensitive recording layer contains at least a substantially colorless color-developing compound A, and a substantially colorless color-developing compound B which reacts with the color-developing compound A to thereby develop color. The color-developing compound A and the color-developing compound B which are used in the present invention are compounds which mutually generate a color-developing reaction by contacting with each other.

Examples 1) to 13) of combinations of such compounds are described below:

1) a combination of diazo compounds that are decomposed by light and couplers;
2) a combination of electron donative dye precursors and electron acceptive compounds;
3) a combination of organometallic salts such as silver behenate and silver stearate, and reductants such as protocatechuic acid, spiroindan, and hydroquinone;
4) a combination of long-chain fatty acid salts such as ferric stearate and ferric myristylate and phenols such as tannic acid, gallic acid and ammonium salycylate;
5) a combination of organic acid heavy metal salts such as nickel, cobalt, zinc, copper, iron, mercury, and silver salts of acetic acid, stearic acid, and palmitic acid either with alkaline earth metal sulfides such as calcium sulfide, strontium sulfide, and potassium sulfide, or with organic chelates such as s-diphenylcarbazide and diphenylcarbazone;
6) a combination of heavy metal sulfates such as sulfates of silver, zinc, mercury, and sodium, and sulfur compounds such as Na-tetrathionate, sodium thiosulfate and thiourea;
7) a combination of fatty acid ferric salts such as ferric stearate, and aromatic polyhydroxy compounds such as 3,4-hydroxytetraphenylmethane;
8) a combination of organic acid metallic salts such as oxalate and mercury oxalate, and organic polyhydroxy compounds such as polyhydroxyalcohol, glycerin, and glycol;
9) a combination of fatty acid ferric salts such as ferric pelargonate and ferric laurate, and thiocetylcarbamide or isothiocetylcarbamide derivatives;
10) a combination of organic acid lead salts such as lead caprate, lead pelargonate, and lead behenate, and thiourea derivatives such as ethylenethiourea, and N-dodecylthiourea;
11) a combination of higher fatty acid heavy metal salts such as ferric stearate and cupric stearate and zinc dialkylditiocarbamate.
12) a combination such as of resorcine and nitoroso compounds for forming oxazine dye; and
13) a combination of formazan compounds and reductants and/or metallic salts.

Among these combinations, in the present invention, 1) the combination of photodecompositive diazo compounds and couplers, 2) the combination of electron donative dye precursors and electron acceptive compounds, and 3) the combination of organometallic salts and reductants are preferable, the combinations 1) and 2) are more preferable, and the combination 1) is particularly preferable.

EXAMPLES

The present invention will next be described by way of examples in more detail, which should not be construed as limiting the invention. Further, the term "parts" means "weight by parts" as far as it is not stipulated otherwise.

Example 1

(1) Manufacturing of Support

A wooden pulp that is LBKP (hard wood bleached pulp) (100 parts by weight) was beaten by a double disk refiner to obtain a Canadian freeness standard of 300 cc or less. To the obtained pulp were added epoxy behenic acid amide (0.5 parts by weight), anionpolyacryl amide (1.0 parts by weight), polyamidepolyamine epichlorohydrine (0.1 parts by weight), and cationic polyacrylamide (0.5 parts by weight) at an absolute dry weight ratio. Untreated paper was made at a basis weight of 100 g/m$^2$ by using an elongated steel paper machine. The surface of the obtained untreated paper was sized by polyvinyl alcohol at an absolute dry weight ratio of 1.0 g/m$^2$ and was subjected to a calender process so as to obtain a density of 1.0.

After the wire surface (reverse surface) of the untreated paper thus obtained was subjected to a corona discharge process, the untreated paper was coated with high density polyethylene by a melting extruder so as to form a resin layer which was formed by a mat surface and which had a thickness of 30 $\mu$m (this surface is called a "reverse surface"). After the polyethylene coated surface of this reverse surface was subjected to a corona discharge process, as an antistatic agent, aluminum oxide (Aluminazol 100 manufactured by Nissan Chemical Industries Co., Ltd.) and silicon dioxide (Snowtex O manufactured by Nissan Chemical Industries Co., Ltd.) were dispersed in water at a weight ratio of 1:2, and the solution thus obtained was coated on the layer in an amount of 0.2 g/m$^2$ after drying (this is called a reverse laminated PE product).

After the felt surface (obverse surface) of the untreated paper was subjected to a corona discharge process, the untreated paper was coated with low density polyethylene which contains 10 wt. % of titanium dioxide and a trace amount of ultramarine blue by a melting extruder so as to form a resin layer which was formed by a glossy surface and which has a thickness of 40 $\mu$m (this surface is called an "obverse surface"). After the polyethylene coated surface of the obverse surface of the resin layer was subjected to a corona discharge process, the resin layer was coated with a gelatin undercoat solution in a dried amount of 0.1 g/m$^2$.

(2) Preparation of Undercoat Layer Solution

A swelling synthetic mica ME100 (manufactured by Co-op Chemical Co., Ltd.) (2.5 parts by weight) and water (97.5 parts by weight) were mixed and dispersed by a dynamill. The resultant solution was added to a 5 wt. % aqueous gelatin solution (200 g) at a temperature of 40° C. and stirred for 30 minutes. To the resultant mixture was added the below-described 5 wt. % surfactant-1 (20 cc), to thereby obtain an undercoat layer solution.

Surfactant-1

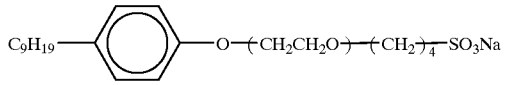

(3) Preparation of Cyan Heat-sensitive Recording Layer Solution:

Preparation of Capsule Solution Which Contains Electron Donative Dye Precursor

1. Solution A

After 3- (o-methyl-p-dimethylaminophenyl)-3-(1'-ethyl-2'-methylindol-3-yl) phthalide (electron donative dye precursor) (5 parts by weight) was dissolved in ethyl acetate (20 parts by weight), to the resultant mixture was added alkylnaphthalene (high boiling point solution) (20 parts by weight), and the result was heated and uniformly mixed.

To the thus obtained solution was added 1:3 adduct of xylylene diisocyanate/trimethylolpropane (20 parts by weight). The resultant mixture was homogeneously stirred, providing solution A.

2. Solution B

A 6 wt. % aqueous phthalic gelatin solution (54 parts by weight) and a 2 wt. % aqueous sodium dodecyl sulfonate solution (2 parts by weight) were mixed, thus preparing solution B.

Solution A was added to solution B. The resultant mixture was emulsified and dispersed by using a homogenizer. The obtained emulsion and water (68 parts by weight) were uniformly mixed.

The resultant mixture was heated to a temperature of 50° C. while being stirred, followed by an encapsulation reaction performed for 3 hours so as to obtain a capsule solution having a mean microcapsule diameter of 1.2 μm.

Preparation of Developer Emulsion Dispersion 1,1-(p-hydroxyphenyl)-2-ethylhexane (developer) (2.5 parts by weight), tricresylphosphate (0.3 parts by weight), and diethyl maleate (0.1 parts by weight) were dissolved in ethyl acetate (10 parts by weight). The resultant solution was added to a mixed aqueous solution of a 6 wt. % aqueous gelatin solution (20 parts by weight) and a 2 wt. % aqueous sodium dodecylsulfonate solution (2 parts by weight). The resultant mixture was emulsified for 10 minutes through use of a homogenizer, to thereby obtain an emulsion dispersion.

Preparation of Coating Solution

A 40 wt. % SBR latex SN-307 (manufactured by Sumitomo ABS Latex Inc.) was added to a capsule solid matter of a capsule solution containing the above-prepared electron donative dye precursor. Thereafter, the capsule solution containing an electron donative dye precursor and a developer emulsion dispersion were mixed at a weight ratio of 1:4, to thereby obtain a cyan heat-sensitive recording layer solution.

(4) Preparation of Magenta Heat-sensitive Recording Layer Solution

Preparation of Capsule Solution Containing a Diazo Compound

After a diazo compound (1) represented by the structural formula described below (which is decomposed by light having a wavelength of 365 nm) (2.0 parts by weight) was dissolved in ethyl acetate (20 parts by weight), to the resultant solution was added alkylnaphthalene (20 parts by weight). The resultant mixture was heated and uniformly mixed. The obtained solution and 1:3 adduct of xylylene diisocyanate/trimethylolpropane (15 parts by weight) used as the capsule wall agent, were uniformly mixed to thereby obtain a diazo compound solution.

The obtained diazo compound solution was added to a mixed solution of a 6 wt. % aqueous phthalic gelatin solution (54 parts by weight) and a 2 wt. % aqueous sodium dodecylsulfonate (2 parts by weight). The resultant mixture was emulsified and dispersed through use of a homogenizer.

The obtained emulsion and water (68 parts by weight) were uniformly mixed. The resultant mixture was heated to a temperature of 40° C. while being stirred, which was followed by an encapsulation reaction performed for 3 hours so as to obtain a mean microcapsule diameter of 1.2 μm, thereby obtaining a capsule solution.

Diazo compound-(1)

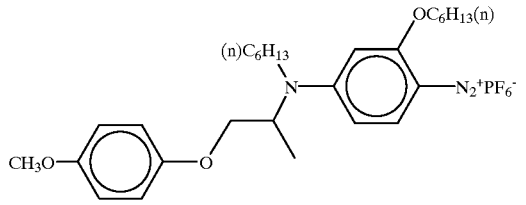

Preparation of Coupler Emulsion Dispersion

A coupler (1) represented by the below-described structural formula (2 parts by weight), 1,2,3-triphenylguanidine (2 parts by weight), tricresylphosphate (0.3 parts by weight), and diethylmaleate (0.1 parts by weight) were dissolved in ethyl acetate (10 parts by weight). The obtained solution was added to a mixed aqueous solution of a 6 wt. % aqueous gelatin solution (20 parts by weight) and a 2 wt. % aqueous sodium dodecylsulfonate solution (2 parts by weight). The resultant mixture was emulsified for 10 minutes through use of a homogenizer, to thereby obtain an emulsion dispersion.

Coupler (1)

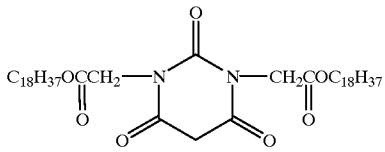

Preparation of Coating Solution

SBR latex SN-307 (manufactured by Sumitomo ABS Latex Inc.) in an amount that was 40 wt. % by weight of the capsule solid matter was added to a capsule solution containing the above-prepared electron donative dye precursor. Thereafter, the capsule solution and a developer emulsion dispersion were mixed at a weight ratio of 3:2, to thereby obtain a magenta heat-sensitive recording layer solution.

(5) Preparation of Yellow Heat-sensitive Recording Layer Solution

Preparation of Capsule Solution Containing a Diazo Compound 2,5-dibutoxy-4-tolylthiobenzene diazonium hexafluorophosphate (a diazo compound which is decomposed by light having a wavelength of 420 nm) (3.0 parts by weight) was dissolved in ethyl acetate (20 parts by weight). To the resultant solution was added alkylnaphthalen (20 parts by weight) as a high boiling point solvent. The resultant mixture was heated and uniformly mixed.

The obtained solution and 1:3 adduct of xylylene diisocyanate/trimethylolpropane (15 parts by weight) used as the material for the capsule wall, were uniformly mixed to thereby provide a diazo compound solution.

The obtained diazo compound solution was added to a mixed solution of a 6 wt. % aqueous phthalic gelatin solution (54 parts by weight) and an aqueous sodium dodecylsulfonate solution (2 parts by weight). The resultant mixture was emulsified through use of a homogenizer. The obtained emulsion dispersion and water (68 parts by weight) were uniformly mixed. The resultant mixture was heated to a temperature of 40° C. while being stirred, which was followed by an encapsulation reaction performed for 3 hours so as to obtain a mean microcapsule diameter of 1.3 μm, thereby obtaining a capsule solution.

Preparation of Coupler Emulsion Dispersion 2-chloro-5-(3-(2,4-di-tert-pentyl) phenoxypropyl amino)-acetanilide (2 parts by weight), 1,2,3-triphenylguanidine (1 part by weight), tricresyl phosphate (0.3 parts by weight) and diethyl maleate (0.1 parts by weight) were dissolved in ethyl acetate (10 parts by weight). The resultant solution was added to a mixed aqueous solution of a 6 wt. % aqueous gelatin solution (20 parts by weight) and a 2 wt. % aqueous sodium dodecylsulfonate solution (2 parts by weight). The resultant mixture was emulsified for 10 minutes through use of a homogenizer, to thereby obtain an emulsion dispersion.

Preparation of Coating Solution

The above-prepared coupler emulsion dispersion and a capsule solution containing a diazo compound were mixed at a weight ratio of 3:2 so as to provide a yellow heat-sensitive recording layer solution.

(6) Preparation of Intermediate Layer Coating Solution

A 15 wt. % aqueous gelatin solution (#750 manufactured by Nitta gelatin K. K.) (10 parts by weight) and a 15 wt. % aqueous polyacrylic acid solution (Julimer-AC-10L manufactured by Japan Pure Medicine Co., Ltd.) (3 parts by weight) were uniformly mixed, to thereby obtain an intermediate layer solution.

(7) Preparation of Light Transmittance Adjusting Layer Coating Solution

A compound described below (1.5 parts by weight) and a compound R-6 as a reductant (0.5 parts by weight) and ethyl acetate (6.0 parts by weight) and tricresyl phosphate (0.8 parts by weight) were mixed and dissolved sufficiently. To the resultant solution were added xylylenediisocyanate/ trimethylolpropane (75% ethyl acetate solution, TAKENATE D-110N manufactured by Takeda Chemical Industries, Ltd.) (3.0 parts by weight) as a capsule wall agent, and the resultant mixture was uniformly stirred. An 8 wt. % aqueous carboxy denatured polyvinylalcohol solution KL-318 (manufactured by Kuraray Co., Ltd.) (29.7 parts by weight) was added to the former solution. The resultant mixture was emulsified through the use of a homogenizer. The resultant emulsion was added to ion exchange water (40 parts by weight) and stirred for three hours at a temperature of 40° C. to thereby perform an encapsulation reaction. Thereafter, to the resultant solution was added ion exchange resin, Amberlite MB-03 (manufactured by Organo Corp.) (7.0 parts by weight). The resultant mixture was stirred for another hour. In this way, a light transmittance adjusting layer coating solution was obtained. The mean particle diameter of capsules was 0.35 $\mu$m.

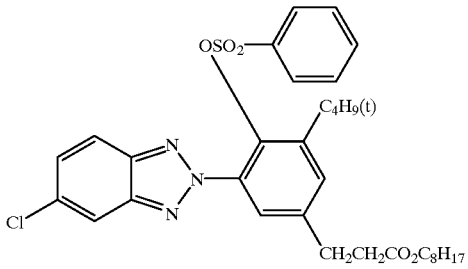

-continued

R-6

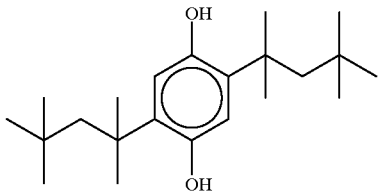

(8) Preparation of a Protective Layer Solution

| | |
|---|---|
| EP130 (7 wt. %) | 100 g |
| Water | 50 g |
| Barifine BF21 dispersion (20 wt. %) | 10 g |
| Surfactant-1 (2 wt. %) | 5 ml |
| Surfactant-2 (5 wt. %) | 5 ml |

wherein the aforementioned EP130 (product name) is dodecyl denatured polyvinyl alcohol manufactured by Denki Kagaku Kogyou K. K., and Barifine BF 21 (product name) is barium sulfate ultra fine grains manufactured by Sakai Chemical Industry Co., Ltd. Further, the aforementioned surfactant-2 is expressed by the following structural equation:

Surfactant-2

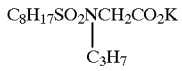

(9) Preparation of Heat-sensitive Recording Material

The undercoat layer solution, the cyan heat-sensitive recording layer solution, the intermediate layer solution, the magenta heat-sensitive recording layer solution, the intermediate layer solution, the yellow heat-sensitive recording layer solution, the light transmittance adjusting layer solution, and the protective layer solution were coated on the aforementioned polyethylene laminated paper support in this order. After drying, the multicolor heat-sensitive recording material 100 was obtained.

Each of these coating solutions was applied in respective amounts as follows when converted to solid amounts after drying: sequential order from the support, undercoat layer 1.0 g/m$^2$, cyan heat-sensitive recording layer 6.1 g/m$^2$, intermediate layer 1.0 g/m$^2$, magenta heat-sensitive recording layer 7.8 g/m$^2$, intermediate layer 1.0 g/m$^2$, yellow heat-sensitive recording layer 7.2 g/m$^2$, light transmittance adjusting layer 1.5 g/m$^2$, and protective layer 1.2 g/m$^2$.

Example 2

| Preparation of protecfive layer solution | |
|---|---|
| EP130 (7 wt. %) | 100 g |
| Water | 52 g |
| Barifine BF21 dispersion (20 wt. %) | 5 g |
| Snowtex C (20 wt. %) (product name: colloidal silica dispersion manufactured by Nissan Chemical Industries, Ltd.) | 5 g |
| Surfactant-1 (2 wt. %) | 10 ml |
| Surfactant-2 (5 wt. %) | 10 ml |
| Surfron S131 (30 wt. %) (product name: fluoridated surfactant manufactured by Asahi | 1.5 g |

-continued

| Preparation of protecfive layer solution | |
|---|---|
| Class Co., Ltd.) | |
| Zinc stearate dispersion | 3 g |

A heat-sensitive recording material was prepared in the same manner as in the example 1 except that the protective layer coating solution has the aforementioned composition.

Example 3

| Preparation of protective layer solution | |
|---|---|
| EP130 (7 wt. %) | 100 g |
| Water | 50 g |
| Barifine BF21 dispersion (20 wt. %) | 7 g |
| Snowtex C (20 wt. %) | 3 g |
| Surfactant-1 (2 wt. %) | 10 ml |
| Surfactant-2 (5 wt. %) | 10 ml |
| Surfron S131 (30 wt. %) | 1.5 g |
| Dialdehyde starch (5 wt. %) | 14 g |
| p-toluenesulfonic acid (10 wt. %) | 0.7 g |

A heat-sensitive recording material was prepared in the same manner as in the example 1 except that the protective layer coating solution has the aforementioned composition.

Example 4

A heat-sensitive recording material was prepared in the same manner as in the example 1 except that the Barifine BF21 dispersion in the example 1 was not added.

Example 5

A heat-sensitive recording material was prepared in the same manner as in the example 3 except that the Barifine BF21 dispersion in the example 3 was replaced by a Barifine BF20 dispersion.

Comparative Example 1

| Preparation of protective layer coating solution | |
|---|---|
| PVA217 (7 wt. %) | 100 g |
| Water | 0.9 g |
| Surfactant-1 (2 wt. %) | 10 ml |
| Surfactant-2 (5 wt. %) | 5 ml |
| ME313 (3 wt. %) (product name: fluoridated oil manufactured by Daikin Co., Ltd.) | 20.0 g |
| Kaolin dispersion (20 wt. %) (average particle diameter: 1.3 μm) | 10.0 g |
| Zinc stearate (20.5 wt. %) | 5.0 g |

A heat-sensitive recording material is formed in such a manner as in the example 1 except that preparation of the protective layer was changed as described above.

Comparative Example 2

A heat-sensitive recording material was formed in the same manner as the comparative example 1 except that the kaolin dispersion in the comparative example 1 was not added.

Each of the heat-sensitive recording materials obtained in the above-described examples and comparative examples was evaluated through the following evaluation method.

Evaluation Method

Feedability: 100 copies of paper were printed successively by a video/digital printer NC-5 manufactured by Fuji Photo Film Co., Ltd. At this time, the frequency at which feeding malfunctions such as simultaneous feeding of a plurality of papers occurred was counted. The smaller the frequency, the better the feedability.

Glossiness: gray printing was performed by a digital printer NC-300D manufactured by Fuji Photo Film Co., Ltd. A portion to be printed and a printed portion were measured at an incident angle of 20° by using a digital deformation glossimeter (UGV-5D manufactured by Suga Test Machine Co., Ltd.). The larger the value, the better the glossiness.

Method of measuring printing torque: A4-size sample paper was conveyed in a lengthwise direction under a head pressure of 7 kg/cm by using a platen roll having a rubber hardness of 60 degrees and a length of 30 cm, and a heat-sensitive recording head whose length is 30 cm, and gradation printing was performed from $D_{min}$ to $D_{max}$. Torque of the platen roll at that time was measured, the torque measured was converted to a kinetic frictional coefficient, and frictional resistance was evaluated on the basis of the maximum value of the kinetic frictional coefficient between the heat-sensitive recording head and the heat-sensitive recording material during printing.

Scratch resistance: the number of scratches formed on the printing surface of the heat-sensitive recording material printed by the video/digital printer NC-5 was evaluated visually. The following values are numbers of scratches in one print averaged from five prints.

The results of the evaluation are shown in Table 2.

TABLE 2

| | Feeding malfunction | Glossiness (%) | | Kinetic frictional | |
|---|---|---|---|---|---|
| | occurrence frequency | Portion to be printed | printed portion | coefficient with head | Scratch resistance |
| Example 1 | 0 | 29.8 | 39.6 | 0.17 | 1.8 |
| Example 2 | 0 | 21.5 | 38.2 | 0.08 | 1.0 |
| Example 3 | 0 | 25.0 | 41.9 | 0.11 | 0.4 |
| Example 4 | 0 | 28.1 | 40.1 | 0.13 | 3.2 |
| Example 5 | 0 | 24.2 | 37.2 | 0.11 | 0.8 |
| Comp. Example 1 | 0 | 2.3 | 13.2 | 0.22 | 4.3 |
| Comp. Example 2 | 3 | 5.6 | 15.0 | 0.32 | 10.5 |

In the heat-sensitive recording materials in the examples, as compared to the comparative examples, feedability is excellent because all of the papers were fed. Further, glossiness was excellent, and frictional resistance was also excellent because no friction was caused during printing between the heat-sensitive recording head and the heat-sensitive recording material. (If the friction between the heat-sensitive recording material and the heat-sensitive recording head is large, interfering noise is caused during printing so that printing misalignment is thereby caused.) The number of scratches formed on the print surface was extremely small.

As described above, according to the present invention, it is possible to provide a heat-sensitive recording material which is excellent in transparency, glossiness, and light-fastness, and which is also excellent in scratch resistance because the heat-sensitive recording material has a protective layer which is excellent in friction resistance and lubricity with respect to a heat-sensitive recording head thus preventing adhesion of the heat-sensitive recording material to the heat-sensitive recording head and deposition of foreign matters thereon.

What is claimed is:

1. A heat-sensitive recording material comprising a support, and a heat-sensitive recording layer and a protective layer which are provided on the support, wherein said protective layer is formed by using at least a long chain alkyl ether denatured polyvinyl alcohol.

2. A heat-sensitive recording material according to claim 1, wherein said long chain alkyl ether denatured polyvinyl alcohol is an alkyl ether denatured polyvinyl alcohol having 8 to 20 carbon atoms.

3. A heat-sensitive recording material according to claim 2, wherein said long chain alkyl ether denatured polyvinyl alcohol is a polymer represented by the following equation (A):

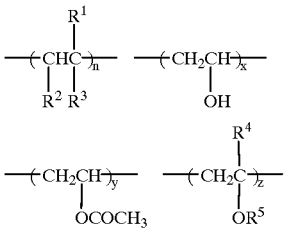

wherein $R^1$ represents a hydrogen atom, a methyl group, or —$CH_2CO_2M$; $R^2$ represents a hydrogen atom or —$CO_2M$; $R^3$ represents a hydrogen atom, —$CO_2M$, an amino group, an amide group, a substituted amide group, a hydroxy group, a glycidyl group, a sulfonic group, a polyethylene oxide group, a polypropylene oxide group, or a group including functional groups of these groups; $R^4$ represents a hydrogen atom or a methyl group; $R^5$ represents an alkyl group having 8 to 20 carbon atoms; M represents a hydrogen atom, an alkyl group, an aryl group, an aralkyl group, Na, K, or Li; and each of n, x, y, and z represents a polymerization degree.

4. A heat-sensitive recording material according to claim 3, wherein said protective layer is formed by using at least a long chain alkyl ether denatured polyvinyl alcohol and another water-soluble binder.

5. A heat-sensitive recording material according to claim 4, wherein said another water-soluble binder is a silicone denatured polymer.

6. A heat-sensitive recording material according to claim 2, wherein said protective layer is formed by using at least a long chain alkyl ether denatured polyvinyl alcohol and another water-soluble binder.

7. A heat-sensitive recording material according to claim 6, wherein said another water-soluble binder is a silicone denatured polymer.

8. A heat-sensitive recording material according to claim 1, wherein said protective layer contains inorganic ultra-fine grains.

9. A heat-sensitive recording material according to claim 8, wherein said protective layer is formed by using at least a long chain alkyl ether denatured polyvinyl alcohol and another water-soluble binder.

10. A heat-sensitive recording material according to claim 9, wherein said another water-soluble binder is a silicone denatured polymer.

11. A heat-sensitive recording material according to claim 1, wherein said protective layer is formed by using at least a long chain alkyl ether denatured polyvinyl alcohol and another water-soluble binder.

12. A heat-sensitive recording material according to claim 11, wherein said another water-soluble binder is a silicone denatured polymer.

13. A heat-sensitive recording material according to claim 1, wherein said protective layer contains dialkyl starch as a crosslinking agent.

14. A heat-sensitive recording material according to claim 1, wherein said protective layer contains said long chain alkyl ether denatured polyvinyl alcohol in an amount of 50% by weight or more.

* * * * *